US008650801B2

(12) United States Patent
Ayshford et al.

(10) Patent No.: US 8,650,801 B2
(45) Date of Patent: Feb. 18, 2014

(54) PRESSURE RELIEF DOOR WITH COUNTERWEIGHT MECHANISM

(75) Inventors: Gordon Timothy Ayshford, Godalming (GB); Victoria Margaret Aruther, Derbyshire (GB); Peter Thomas McGuigan, Selborne (GB)

(73) Assignee: BHA Altair, LLC, Franklin, TN (US)

( * ) Notice: Subject to any disclaimer, the term of this patent is extended or adjusted under 35 U.S.C. 154(b) by 332 days.

(21) Appl. No.: 13/037,776

(22) Filed: Mar. 1, 2011

(65) Prior Publication Data

US 2012/0222359 A1 Sep. 6, 2012

(51) Int. Cl.
*E05F 1/00* (2006.01)

(52) U.S. Cl.
USPC ..... 49/387

(58) Field of Classification Search
USPC ..... 49/197, 200, 386, 397; 292/1, 262, 344, 292/DIG. 65, DIG. 22; 16/400, 401; 220/828
See application file for complete search history.

(56) References Cited

U.S. PATENT DOCUMENTS

| | | | | |
|---|---|---|---|---|
| 2,004,947 | A | 6/1935 | Irsch et al. | |
| 2,126,994 | A | 8/1938 | Irsch et al. | |
| 2,681,165 | A * | 6/1954 | Kornhauser et al. | 220/813 |
| 3,916,945 | A * | 11/1975 | Bennett | 137/445 |
| 3,921,546 | A | 11/1975 | Makuch | |
| 3,957,001 | A | 5/1976 | Round | |
| 4,198,927 | A * | 4/1980 | Guiavarc'h | 119/524 |
| 5,031,655 | A * | 7/1991 | Hebaus | 137/202 |
| 2004/0064883 | A1 * | 4/2004 | Appleford et al. | 4/555 |

* cited by examiner

*Primary Examiner* — Katherine Mitchell
*Assistant Examiner* — Catherine A Kelly
(74) *Attorney, Agent, or Firm* — Reinhart Boerner Van Deuren P.C.

(57) ABSTRACT

A counterweight mechanism that includes a radial arm with a weight and a series of elements interconnected between the door and the arm. The weight provides a closing force when in a first position and provides an opening force when in another position. The weight may be an over center weight and the closing force reduces when the weight moves toward an over center position. The counterweight mechanism may require manual resetting after the weight is in the second position. Door movement may be though an angle that is less than an angle of movement of the radial arm.

18 Claims, 4 Drawing Sheets

PRESSURE RELIEF DOOR WITH COUNTERWEIGHT MECHANISM

BACKGROUND OF THE INVENTION

1. Field of Invention

The present invention relates to a counterweight mechanism for a pressure relief door which may be used in a filterhouse of a gas turbine intake system.

2. Discussion of Prior Art

The use of a counterweight mechanism on a pressure relief door is known. In a gas turbine intake system, an associated filterhouse conventionally has a pressure relief door. A pressure relief door can be provided as a blow-in door for a filterhouse. Such a blow-in door opens when the pressure inside the filterhouse goes lower than a specified amount below the surrounding ambient atmospheric pressure (i.e., a specified pressure differential is exceeded). Exceeding the specified pressure differential can occur due to a variety of reasons, such as blockage of the filtration media. Opening the door (e.g., a blow-in door) may help to protect the intake system from damage. In addition, opening the door can help maintain sufficient airflow to the turbine and possibly avoid or delay the need for a shutdown.

In order to maintain the door in a closed condition prior to experiencing a pressure differential exceeding the specified pressure differential, it is known to fixedly attach a counterweight to the door. Prior to opening, the door is held closed by a moment force that results from the weight of counterweight acting about the pivot axis of the door. The closing moment force ($M_{closing}$) is calculated as follows:

$$M_{closing}=W\cdot X$$

where W is the weight, of the counterweight and X is the horizontal distance from the counterweight to the pivot axis of the door. The difference between the pressure outside the filterhouse and the pressure inside the filterhouse creates an opening force upon the door. When the opening force is greater than the closing moment force, the door pivots open.

However, there are several shortfalls with existing counterweight mechanisms. A first shortfall noted by the inventors is that as the door opens, the horizontal distance (X within the moment force equation) of the counterweight from the pivot axis decreases. Consequently, the closing moment force decreases once the door begins to move from a fully closed position. It has also been noted that, simultaneously, the opening force decreases as the pressure drop is relieved by the movement of the door from its fully closed position. The combination of these factors may cause the door to vibrate or "flutter" movement as it hunts in an effort to achieve equilibrium. Still further, it has been noted that the door will naturally tend to continue to move freely because the door may not have external damping and may possess a high level of inertia. Unfortunately, some operators may weld the pressure relief door shut to prevent such flutter.

Moreover, some existing counterweights are attached to the door at the side of the door within the filterhouse. If the counterweight needs to be serviced or adjusted, the gas turbine may need to be shut down for workers to gain access to the counterweight located within the filterhouse. Such turbine shutdown may be economically costly. Also, servicing the counterweight within the filter housing may involve a need for workers to access the clear air path. This may add further complication, such as the need to acquire applicable permits and the potential for contamination. Furthermore, there may be other issues associated with counterweight components that may become loose if the location of the counterweight is within the filter housing.

Thus, there is need for improvements to address such issues.

BRIEF DESCRIPTION OF THE INVENTION

The following summary presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

In accordance with one aspect, the present invention provides a counterweight mechanism for applying a closing urging force at a first condition to a door and an opening urging force at a second, different condition to the door. The counterweight mechanism includes a series of elements operatively connected in sequence and extending from the door. The series of elements move during movement of the door. The counterweight mechanism also includes a radial arm and a weight fixed to the radial arm. The radial arm and weight are pivotally supported and operatively connected to the series of elements for movement of the radial arm and weight during movement of the door and the series of elements. The weight provides the closing urging force that is transmitted through the radial arm and the series of elements to the door when the weight is in a first position. The closing urging force is reduced as the weight moves toward a second position. The weight provides the opening urging force when the weight is in a third position.

In accordance with another aspect, the present invention provides a counterweight mechanism for applying a closing urging force at a first condition to a door and an opening urging force at a second, different condition to the door. The door is supported for pivot movement about an axis. The counterweight mechanism includes a series of elements operatively connected in sequence and extending from the door. The series of elements move during movement of the door. The counterweight mechanism also includes a radial arm and a weight fixed to the radial arm. The radial arm and weight are pivotally supported for movement about an axis and operatively connected to the series of elements for pivot movement of the radial arm and weight during simultaneous pivot movement of the door. The radial arm and weight are movable from a first position, in which the weight provides the closing urging force, through a second position and to a third position, in which the weight provides the opening urging force. The pivot movement of the radial arm and weight between the first and third positions is a first angle amount and the simultaneous pivot movement of the door is through a second angle, the second angle is less than the first angle.

In accordance with still another aspect, the present invention provides a counterweight mechanism for applying a closing urging force at a first condition to a door and an opening urging force at a second, different condition to the door. The counterweight mechanism includes a series of elements operatively connected in sequence and extending from the door. The series of elements move during movement of the door. The counterweight mechanism also includes a radial arm and a weight fixed to the radial arm. The radial arm and weight are pivotally supported for movement about an axis and operatively connected to the series of elements for pivot movement of the radial arm and weight during simultaneous pivot movement of the door. The radial arm and weight are movable from a first position, in which the weight provides the closing urging force, through a second position and to a third position, in which the weight provides the opening urging force. The counterweight mechanism is configured such that once the radial arm and weight are in the third position the counterweight mechanism cannot independently move the radial arm and weight toward the first and second positions. A resetting force from a source other than from the counterweight mechanism and the door is required to move the radial arm and weight from the third position toward the first and second positions.

BRIEF DESCRIPTION OF THE DRAWINGS

The foregoing and other aspects of the invention will become apparent to those skilled in the art to which the invention relates upon reading the following description with reference to the accompanying drawings, in which.

DETAILED DESCRIPTION OF THE INVENTION

Figure 1:
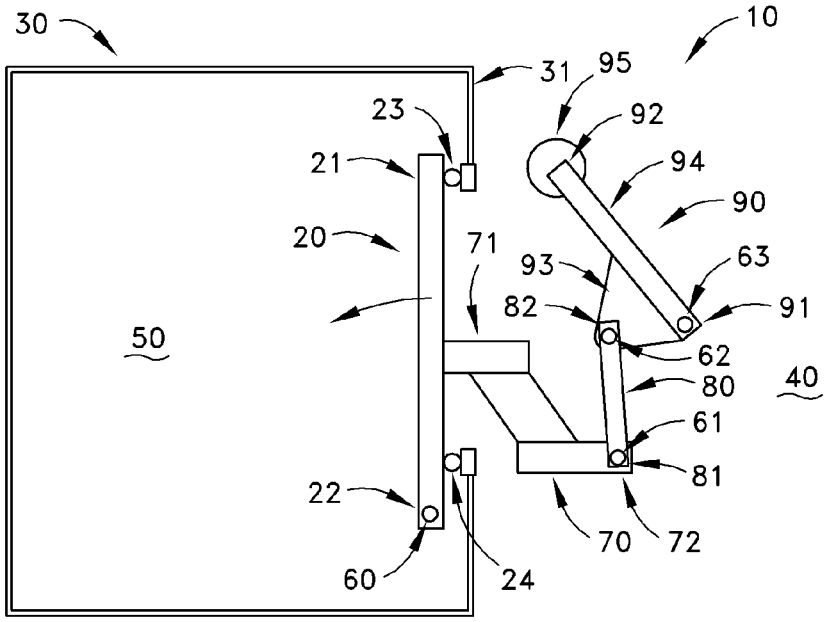
FIG. 1 is a schematic illustration of a counterweight mechanism for a pressure relief door of a filterhouse in accordance with one aspect of the present invention and with the counterweight mechanism and the door in a first position.

Example embodiments that incorporate one or more aspects of the invention are described and illustrated in the drawings. These illustrated examples are not intended to be overall limitations on the invention. For example, one or more aspects of the invention can be utilized in other embodiments and even other types of devices. Moreover, certain terminology is used herein for convenience only and is not to be taken as a limitation on the invention. Still further, in the drawings, the same reference numerals are employed for designating the same elements.

FIG. 1 schematically illustrates an example counterweight mechanism 10, according to one aspect of the invention, in connection with an example filterhouse 30. In one specific example, the filterhouse 30 is part of a gas turbine system. It should be appreciated that, although the example is presented in connection with the filterhouse 30, the counterweight mechanism 10 could be used in a different part of the gas turbine system, such as a duct. Also, is should be appreciated that the counterweight mechanism 10 could be used within other systems that are different from a gas turbine system.

It is to be appreciated that all of the Figures are schematic and thus do not pictorially represent the actual structures. For example, the filterhouse 30 is only represented as a simple box, but in reality the filterhouse may be a much more complex and/or larger structure. The filterhouse 30 and the various components described herein are made of any suitable materials, such as metal or another durable material suitable for the environment.

As shown in FIG. 1, a pressure relief door 20 is provided in the filterhouse 30. The pressure relief door 20 is for selectively blocking a passage opening between ambient atmosphere 40 outside the filterhouse 30 and the internal atmosphere 50 within the filterhouse 30. In one example, the pressure relief door 20 can provide a bypass passage so air need not flow through filtration media of one or more filters (not shown). This may be necessary if there is a blockage in the filtration media which impedes air flow through the filtration media and which causes an undesirably low pressure for the internal atmosphere 50 within the filterhouse 30.

Turning first to the pressure relief door 20, the door 20 has a first end portion 21 and a second end portion 22. The door 20 pivots relative to a wall 31 of the filterhouse 30 about a first pivot axis 60 (perpendicular to the plane of the drawing). Within FIG. 1, an arrowhead extending from the door 20 indicates an ability to pivot from a first, closed position, which is the position of the door in FIG. 1. The first pivot axis 60 is at a fixed location relative to the wall 31 and is at the second end portion 22 of the door 20. The first pivot axis 60 may be provided by a hinge or the like that pivotally couples the door 20 to the wall 31. Bearings, bushings and the like may be employed within the hinge. Of course, the representation is merely schematic and various types of pivot connections can be employed to provide the first pivot axis 60.

The door 20 may close directly against the filterhouse wall 31. Alternatively, as shown in FIG. 1, a sealing arrangement, as represented by seal segments 23 and 24, may be provided between the door 20 and the filterhouse wall 31. For example, a first seal segment 23 may be provided adjacent to the first end portion 21 of the door 20, and the second seal segment 24 may be provided adjacent to the second end portion 22 of the door 20, and so on around the perimeter. The seal segments 23 and 24 may be made of a resilient material and may compress when contacting the door 20. Again, the representation is schematic and variations can be employed. For example, it should be appreciated that the drawings are schematic and do not depict the seal compression.

The counterweight mechanism 10 is attached to the door 20 outside the filterhouse 30. The present embodiment of the counterweight mechanism 10 includes an extension member 70, a linkage 80, a radial arm 90, and a counterweight 95. However, the counterweight mechanism 10 can include various combinations of these and other components, and the present embodiment is merely one example.

Focusing on the extension member 70, the extension member is an overall rigid member and the shown example has three rigid portions interconnected to have a shape similar to a "Z" shape. The shape helps to avoid contact with the filterhouse wall 31. Other shapes are possible. For example, the extension member 70 could be shaped like a rectangle or another polygon. So long as the extension member 70 can move without interference with the filterhouse wall 31, the shape of the extension member 70 can be altered in order to position the other components of counterweight mechanism 10 as desired. Turning to specific details of the shown example, a first end portion 71 of the extension member 70 is rigidly attached to the door 20, such as by welding, fasteners (e.g., screws) and/or adhesive. The extension member 70 extends from the door 20 and beyond the filterhouse wall 31 to a second end portion 72. With the extension member 70 rigidly attached to the door 20, the extension member 70 moves with the door 20 about the first pivot axis 60. Thus, the second end portion 72 moves in an arc about the first pivot axis 60. For example, when the door 20 pivots away from first position shown in FIG. 1 about the first pivot axis 60 as shown by the arrowhead, movement of the second end portion 72 is generally upward.

Turning to the linkage 80, the linkage is a rigid member and the example is shown as a rectangular member, but other shapes are possible. The linkage 80 has a first end portion 81 and a second end portion 82. The first end portion 81 of the linkage 80 is pivotally connected to the second end portion 72 of the extension member 70 at a second pivot axis 61 (perpendicular to the plane of the drawing). Bearings, bushings, pins and the like may be employed within structure (e.g., a hinge) that provides the second pivot axis 61. The second pivot axis 61 moves in space through the arc with the second end portion 72 of the extension member as the door 20 pivots. The first end portion 81 of the linkage 80 also moves in the arc about the first pivot axis 60, but also the second pivot axis 61 allows relative pivoting between the linkage 80 and the extension member 70.

The radial arm 90 is a rigid member and includes a rectangular member 94 and a triangular connecting member 93 extending from the rectangular member 94. Similar to the other counterweight mechanism components, the shape of the radial arm 90 can vary. The rectangular member 94 has a first end portion 91 and a second end portion 92. The triangular connecting member 93 is fixed to the rectangular member 94 adjacent to the first end portion 91. The radial arm 90, at the triangular connecting member 93, is pivotally connected to the second end portion 82 of the linkage 80 at a third pivot axis 62 (perpendicular to the plane of the drawing). Bearings, bushings, pins and the like may be employed within structure (e.g., a hinge) that provides the third pivot axis 62.

It is to be appreciated that the extension member 70 and the linkage 80 provide an example of a series of elements that is operatively connected in sequence and that extends from the door 20. As will be appreciated the series of elements move during movement of the door 20. Also, it is to be appreciated that the series of elements can be varied/modified. Such variation/modification may include a different number of elements.

The radial arm 90 also has a fourth pivot axis 63 (perpendicular to the plane of the drawing). The fourth pivot axis 63 is fixed is space such that the fourth pivot axis 63 cannot translate to a different location. Another way of saying this is that the fourth pivot axis 63 does not translate to a different location relative to the filterhouse 30. The only movement that is permitted at the fourth pivot axis 63 is rotational movement of the radial arm 90 about the fourth pivot axis 63. Thus, the structure that provides the fourth pivot axis 63 includes structure that is fixed relative to the filterhouse 30 and structure that permits pivoting relative to the fixed structure. A hinge, with bearings, bushings, pins and/or the like may be employed within structure that provides the fourth pivot axis 63. As an example, a pivot pin could extend through the fourth pivot axis 63 and be connect to a fixed frame. The frame could connect to the filterhouse wall 31, floor, or other stationary structure.

Turing to movement of the radial arm 90, the third pivot axis 62 moves as the door 20 pivots. Specifically, since the extension member 70 moves in an arc, the linkage 80 moves. The movement of the linkage 80 includes a generally upward movement. It is to be noted that the fourth pivot axis 63 is fixed against translation movement and thus constrains the radial arm 90 to only pivotally move about the fourth pivot axis 63. Recall that upward movement of the linkage 80 causes generally upward movement of the third pivot axis 62 at the triangular connecting member 93 of the radial arm 90. Of course, this upward movement of the third pivot axis 62 is just one component of the movement of the third pivot axis 62 since the third pivot axis 62 is constrained, along with the entire radial arm 90, to pivot about the fourth pivot axis 63.

The counterweight 95 is fixedly attached to the second end portion 92 of the radial arm 90. The counterweight 95 moves with the radial arm 90 about the fourth pivot axis 63. As such, the counterweight 95 moves in an arc about the fourth pivot axis 63. It is to be appreciated that along the arc the counterweight 95 will be at different heights and thus will have different levels of potential energy. Also, since the counterweight 95 is at a distance from the fourth pivot axis 63, the counterweight provides a force moment that varies dependent upon position of the counterweight 95.

It is to be appreciated, the counterweight 95 is sized to be sufficiently heavy in order to keep the door 20 closed (or open) as desired. In other embodiments, an alternative counterbalance force could replace the counterweight 95. For example, a mechanical spring force, compressed gas pressure, electrically generated force, or magnetic force could replace the counterweight 95. At this point it might be worth noting that the counterweight mechanism 10 can be modified in a variety of ways. For example, the weight of the counterweight 95 and length of the radial arm 90 can be varied. In one example a relatively heavier counterweight 95 can coupled to a relatively shorter radial arm 90, and in another example a relatively lighter counterweight 95 can be coupled to a relatively longer radial arm 90. It is noted that a relatively shorter radial arm 90 may help provide quicker resistance decay during operation.

As shown in the embodiment of FIG. 1, the counterweight mechanism 10 is located outside the filterhouse 30. Such a location makes the counterweight mechanism 10 easily accessible (e.g., for adjusting or servicing). It is possible that turbine shutdown may be avoided when the counterweight mechanism 10 accessed. Also it is possible that workers need not enter the clean air path when the counterweight mechanism 10 accessed. Moreover, such a location reduces the number of components within the airflow.

The operation of the counterweight mechanism 10 will now be described. FIG. 1 shows the door 20 and counterweight mechanism 10 in the first position. In this first position, the door 20 is closed and the radial arm 90 is angled toward the door 20, and the counterweight 95 is positioned toward the door 20 and at a relatively low-height location (i.e., lower than a maximum possible height). The counterweight 95 cannot go lower because the door is at a fully closed position (e.g., cannot rotate any further in the clockwise direction as viewed in the Figures). The counterweight mechanism 10 and door 20 will remain in this first position until the difference between the pressure of the ambient atmosphere 40 outside the filterhouse 30 and the pressure of the internal atmosphere 50 inside filterhouse 30 reaches a predetermined value. In particular, when the counterweight mechanism 10 is in the first position of FIG. 1, it imparts a closing force to the door 20. Specifically, the counterweight 95 urges the radial arm 90 to rotate counter clockwise as shown within the Figures. A force is transmitted from the radial arm 90 to the linkage 80 via the third pivot axis 62. This transmitted force from the radial arm 90 urges the linkage 80 generally downward. In turn, the generally downward force is transmitted through the linkage 80 and to the extension member 70 at the second pivot axis 61. The downward force at the second pivot axis 61 imparts a rotational force to the extension member 70 and thus the door 20 in a clockwise direction about the first pivot axis 60. Thus, the effect is to urge the door 20 into the closed position (as shown in FIG. 1). This can be considered to be a first condition of the counterweight mechanism 10 (i.e., the condition of applying a closing urging force).

A pressure differential between the ambient atmosphere 40 outside the filterhouse 30 and the pressure of the internal atmosphere 50 inside filterhouse 30, with the internal atmosphere pressure being lower than the ambient atmosphere pressure, imparts an opening urging force to the door 20. As the pressure differential (internal atmosphere pressure being lower than the ambient atmosphere pressure) increases, the opening urging force imparted to the door 20 increases. When the opening urging force from the pressure differential exceeds the closing urging force from the counterweight mechanism 10, the door 20 will begin to open toward a second position of FIG. 2. The door's change in position from the first position of FIG. 1 to the second position of FIG. 2 defines an angle A.

Figure 2:
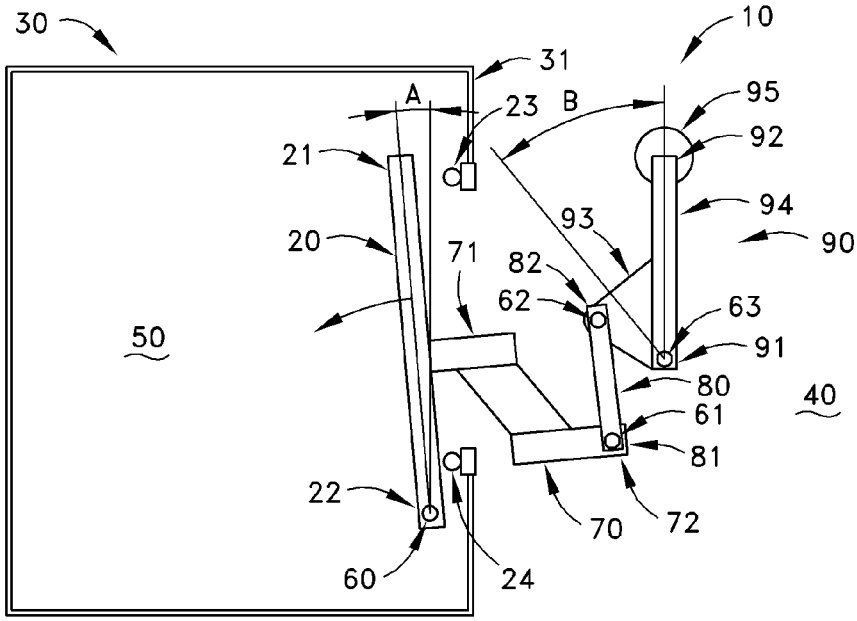
FIG. 2 is a schematic illustration similar to FIG. 1, but with the counterweight mechanism and the door in a second position.

A comparison of the differences between the first and second positions shown in FIGS. 1 and 2, respectively, will help to understand the movement of the portions of the counterweight mechanism 10. The extension member 70 is fixed to the door 20 and pivots with the door 20 about the first pivot axis 60 (i.e., the extension member moves in an arc about the first pivot axis 60).

The linkage 80 is moved generally upwardly as the second pivot axis 61 moves in the arc about the first pivot axis 60. The movement of the linkage 80 transmits a force acting on the radial arm 90 at the third pivot axis 62. Since radial arm 90 is held to pivot about the fourth pivot axis 63, the force from the linkage 80 causes the radial arm 90 to pivot clockwise about the fourth pivot axis 63. The clockwise movement of the radial arm 90 causes the counterweight 95 to be lifted from the first position (FIG. 1) toward the second position (FIG. 2). Thus, the series of elements (e.g., extension member 70 and linkage 80), which interconnect between door 20 and the radial arm 90, move and transmit force.

The radial arm 90 and counterweight 95 may reach a vertical or over-center position, as shown in FIG. 2. In this position, the counterweight 95 has neither an opening force nor a closing force. This due to the fact that a weight force from the counterweight 95 is directed exactly through the fourth pivot axis 63.

It is worth noting that the movement of the door 20 about the first pivot axis 60 can be at a different angular rate than the rate of movement of the radial arm 90 and counterweight 95 about the fourth pivot axis 63. The shown example has such difference in angular rates of movement. Specifically, the change in position of the door 20 from the first position of FIG. 1 to the second position of FIG. 2 defines an angle A and the change in position of the radial arm 90 and counterweight 95 from the first position of FIG. 1 to the second position of FIG. 2 defines an angle B, with angle B is greater than angle A.

After the door 20 opens, the difference between the pressure of the ambient atmosphere 40 outside the filterhouse 30 and the pressure of the internal atmosphere 50 inside filterhouse 30 decreases. Consequently, the opening urging force decreases. At the same time, the closing urging force from the counterweight mechanism 10 decreases (i.e., is reduced) as the counterweight mechanism 10 moves toward the second position of FIG. 2. At the second position, the counterweight mechanism 10 does not provide a closing urging force. Actually, no force (i.e., zero force) is transmitted to the door at this position. This is the "over center" position of the counterweight 95.

Figure 3:
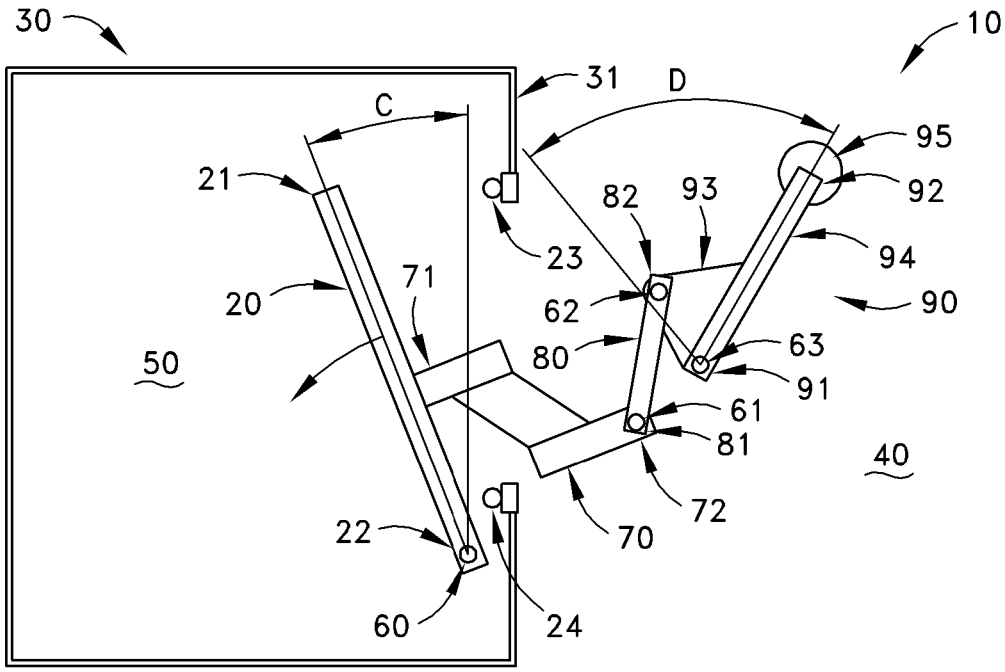
FIG. 3 is a schematic illustration of similar to FIG. 1, but with the counterweight mechanism and the door in a third position.

Until the counterweight 95 goes over center (i.e., past the position shown in FIG. 2), the door 20 may begin to close any time the closing urging force is greater than the opening urging force. However, if the counterweight mechanism 10 reaches the second position of FIG. 2 and there is still a pressure difference sufficient to impart an opening urging force, the door 20 and counterweight mechanism 10 will continue to rotate toward a third position, as shown in FIG. 3.

After the counterweight 95 goes over center, it provides an opening urging force to the door. The opening urging force is transmitted to the door via the series of elements (i.e., the linkage 80 and the extension member 70). In particular, a generally upward force is transmitted from the radial arm 90 to the linkage 80, and in turn the linkage transmits a force to the extension member 70 that causes rotation (counter-clockwise as viewed in the FIG. 3). This can be considered to be a second condition of the counterweight mechanism 10 (i.e., the condition of applying an opening urging force). This opening force increases as the counterweight 95 continues to rotate due to an increasing moment arm caused by an increased horizontal distance to the right from the fourth pivot axis 63. It is to be noted that one or more stops (not shown) may be provided for engagement with one of more portions of the counterweight mechanism 10 and/or the door 20 to limit the amount of movement of the counterweight mechanism 10 and/or the door 20 to only reach the third position.

In the third position (FIG. 3), the door 20 is open a relatively large amount and the radial arm 90 is angled away from the door 20. The simultaneous change in position of the door 20 from the first position of FIG. 1 to the third position of FIG. 3 defines an angle C, and the change in position of the radial arm 90 and counterweight 95 defines an angle D. Just as angle B is greater than angle A, angle D is greater than angle C due to the different rates of simultaneous angular movement. Alternatively, it can be stated that angle A is less than angle B and angle C is less than angle D.

Once the counterweight 95 goes over center (i.e., past the position shown in FIG. 2 and toward the position shown in FIG. 3), the door 20 will remain open even if the pressure differential is relieved. The counterweight mechanism 10 cannot independently move the radial arm 90 and the counterweight 95 toward the first and second positions. A resetting force from a source other than from the counterweight mechanism 10 and the door 20 is required to move the radial arm 90 and the counterweight 95 from the third position toward the first and second positions. Specifically, the resetting occurs via movement of the counterweight mechanism 10 and/or the door 20 past the position shown within FIG. 2 toward the position shown within FIG. 1. Typically, the counterweight mechanism 10 is reset by an operator in order for the door 20 to close. In one example, the resting is done manually by the operator.

As mentioned, the door 20 opens at a selected pressure differential. In addition, the counterweight mechanism 10 can be selected so that the door 20 remains open as the pressure differential is relieved. Consequently, the counterweight mechanism 10 can be configured such that the door 20 can close at a different pressure differential than the pressure differential that causes opening. It is to be appreciated that the particulars that can be varied to select pressure differential (for opening and/or closing) can include variations in the orientations, positions, lengths, and weights of the counterweight mechanism components.

Figure 4:
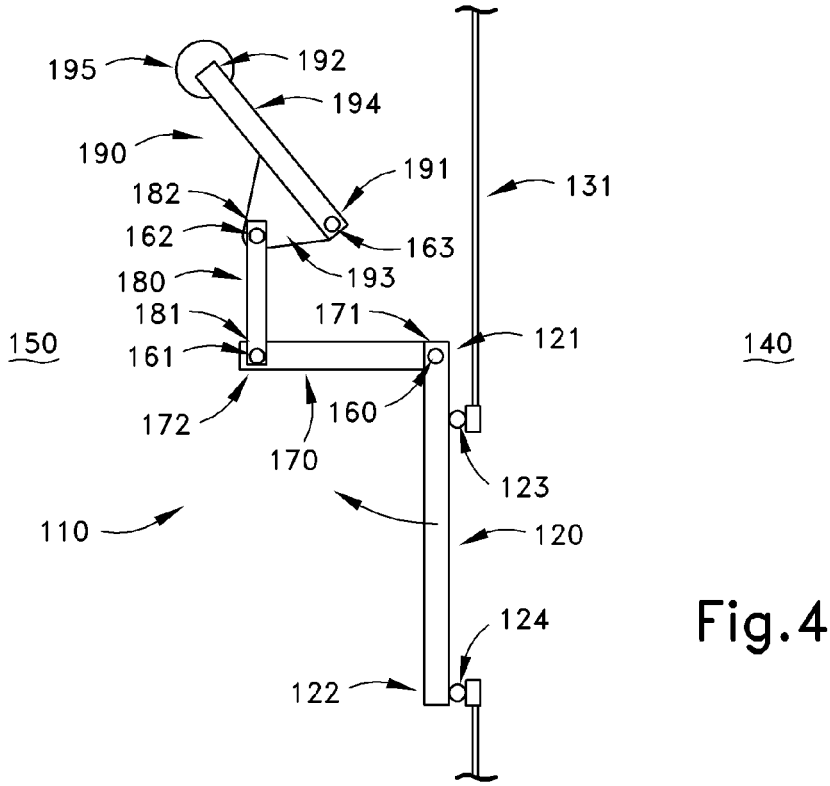
FIG. 4 is a schematic illustration of a second counterweight mechanism for a pressure relief door of a filterhouse in accordance with another aspect of the present invention, with the counterweight mechanism and the door in a first position.
Figure 5:
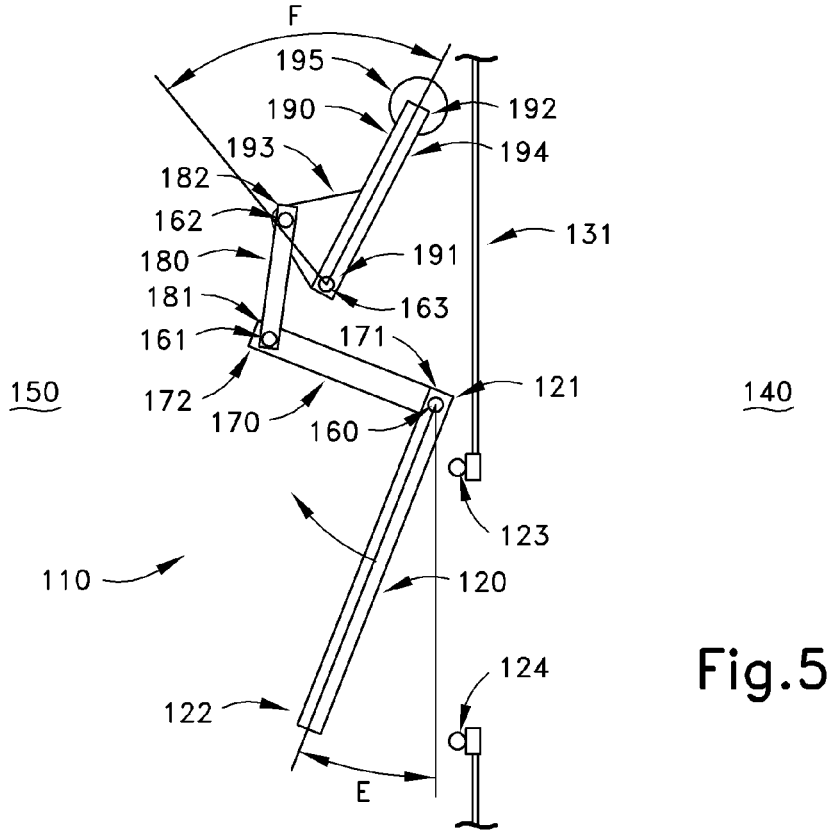
FIG. 5 is a schematic illustration similar to FIG. 4, but with the counterweight mechanism and the door in another position.

FIGS. 4 and 5 schematically illustrate a second embodiment of a counterweight mechanism 110 in a filterhouse (only a portion of the schematically-represented filterhouse is shown). As one aspect, the second embodiment shows that the counterweight mechanism 110 can be located within an internal atmosphere 150 of the filterhouse. A door 120 has a first end portion 121 and a second end portion 122. The door 120 is supported to pivot relative to a wall 131 of the filterhouse about a first pivot axis 160 (perpendicular to the plane of the drawing). The first pivot axis 160 is at a fixed location relative to the filterhouse wall 131. The first pivot axis 160 is adjacent to the first end portion 121 of the door 120. A seal arrangement (e.g., segments 123 and 124) may optionally be provided on the filterhouse wall 131. For example, a first seal segment 123 may be provided adjacent to the first end portion 121 of the door 120, and a second seal segment 124 may be provided adjacent to the second end portion 122 of the door 120, and so on. The seal segments 123 and 124 are made of a resilient material and may compress when contacting the door 120. It should be appreciated that the drawings are schematic and do not the complete seal arrangement and do not depict the seal compression.

A counterweight mechanism 110 is attached to the door 120 within the internal atmosphere 150 of the filterhouse. The present embodiment of the counterweight mechanism 110 includes an extension member 170, a linkage 180, a radial arm 190, and a counterweight 195.

Focusing on the extension member 170, the extension member 170 has a first end portion 171 and a second end portion 172. The first end portion 171 of the extension member 170 is fixedly attached to the door 120. The extension member 170 is rectangular shaped, but other shapes are possible.

Turning to the linkage 180, the linkage 180 has a first end portion 181 and a second end portion 182. The linkage 180 is shown as a rectangular member, but other shapes are possible. The first end portion 181 of the linkage 180 is pivotally connected to the second end portion 172 of the extension member 170 at a second pivot axis 161 (perpendicular to the plane of the drawing). In view of the fact that the second pivot axis 161 is at the second end portion 172 of the extension member 170, the second pivot axis 161 moves in an arc about the first pivot axis 160 as the door 120 pivots. The movement of the second pivot axis 161 clockwise (as viewed in the Figures) in an arc about the first pivot axis 160 causes a general lifting force to be applied to the linkage 180.

It is to be appreciated that the extension member 170 and the linkage 180 provide an example of a series of elements that is operatively connected in sequence and that extends from the door 120. As will be appreciated the series of elements move during movement of the door. Also, it is to be appreciated that the series of elements can be varied/modified. Such variation/modification may include a different number of elements.

The radial arm 190 includes a rectangular member 194 and a triangular connecting member 193 affixed thereto. The radial arm 190 has a first end portion 191 and a second end portion 192, with the triangular connecting member 193 being generally at the first end portion 191. Similar to the other counterweight mechanism components, the shape of the radial arm 190 can vary. The connecting member 193 of the radial arm 190 is connected to the second end portion 182 of the linkage 180 at a third pivot axis 162 (perpendicular to the plane of the drawing).

The radial arm 190 connected to pivot about a fourth pivot axis 163 (perpendicular to the plane of the drawing). The fourth pivot axis 163 is based upon pivot connection of the radial arm 190 to a fixed portion (e.g., a stationary portion of the filterhouse) and thus the fourth pivot axis 163 does not have translation movement during operation. In other words, the radial arm 190 can only pivot about the fourth pivot axis 163 because the fourth pivot axis 163 is at a stationary point in space. Thus, if the linkage 180 is moved upwardly from the position shown in FIG. 4, the radial arm 190 is rotated clockwise about the fourth pivot axis 163 from its position shown in FIG. 4.

The counterweight 195 is fixedly attached to the second end portion 192 of the radial arm 190. A weight amount for the counterweight 195 and/or a radial length of the radial arm 190 can be selected to provide a desired force profile during movement. The selection of weight and/or length may be based upon some of the same considerations discussed in connection with the first embodiment. Also, in general it is to be appreciated that the materials, constructions, and configurations (e.g., compositions of the several pivot axes) of the second embodiment (FIGS. 4 and 5) may be identical or similar materials, constructions, and configurations of the first embodiment (FIGS. 1-3). It is to be further appreciated that the operation of the second embodiment (FIGS. 4 and 5) is somewhat similar to the operation of the first embodiment (FIGS. 1-3). In particular, the operation of the door 120 and counterweight mechanism 110 of the second embodiment is similar to the operation of the first embodiment because it also has an over-center configuration.

Turning to some of the details of the operation of the second embodiment, FIG. 4 shows the door 120 and counterweight mechanism 110 in a first position. In this position, the door 120 is closed and the radial arm 190 is angled away from the door 120. The counterweight mechanism 110 and door 120 will remain in this position until a pressure differential between the ambient atmosphere 140 outside the filterhouse and the internal atmosphere 150 inside filterhouse reaches a predetermined value. In particular, the door 120 will open when an opening urging force from the pressure differential (i.e., the internal atmosphere pressure inside filterhouse being lower that the ambient atmosphere pressure outside the filterhouse) is greater than a closing urging force from the counterweight mechanism 110.

During operation in which the door 120 opens (as shown by the arrowhead within FIG. 4) the extension member 170, which is fixed to the door 120, pivots with the door 120 about the first pivot axis 160. The linkage 180 is moved generally upward due to the pivotal connection with the extension member 170 at the second pivot axis 161. In addition, the generally upward movement of the linkage 180 imparts a generally upward force acting on the radial arm 190. In view of the radial arm 190 being permitted to only rotate about the fourth pivot axis 163 (i.e., no translational movement), the radial arm 190 rotates clockwise (as viewed in FIG. 4) about the fourth pivot axis 163. Thus, the series of elements (e.g., extension member 170 and linkage 180), which interconnect between door 120 and the radial arm 190, move and transmit force.

The radial arm 190 and counterweight 195 may reach a vertical or over-center position. Such an over-center position is not shown, but is an intermediate position between the position shown within FIG. 4 and the position shown within FIG. 5. In such an over-center position, the counterweight 195 does not provide either an opening urging force or an urging closing force.

After the door 120 opens, the pressure differential (i.e., the internal atmosphere pressure inside filterhouse being lower that the ambient atmosphere pressure outside the filterhouse) decreases. Consequently, the opening urging force decreases.

At the same time, the closing urging force from the counterweight mechanism 110 decreases as the counterweight 195 moves toward the over-center position. Until the counterweight 195 goes over center, the door 120 may begin to close any time the closing urging force is greater than the opening urging force. As such, if the counterweight 195 reaches the over-center position and there is still a opening urging force from the pressure differential, the door 120 and counterweight mechanism 110 will continue to move toward the position as shown in FIG. 5. After the counterweight 195 goes over center, the counter weight will provide an opening urging force. This opening urging force increases as the counterweight 195 continues to rotate. It is to be appreciated that a stop may be employed to limit the amount of movement of the counterweight 195, other portion of the counterweight mechanism 110 or the door 120. It is to be appreciated that once the counterweight 195 goes over center, the door 120 will remain open even if the pressure differential is relieved. The counterweight mechanism 110 must be reset (e.g., manually) by an external force, such as from an operator, in order for the door 120 to close.

In the position of FIG. 5, the door 120 is open and the radial arm 190 is angled toward the door 120. The change in position of the door 120 from the position of FIG. 4 to the position of FIG. 5 defines an angle E, and the change in position of the radial arm 190 and counterweight 195 defines an angle F. Angle F can be greater than angle E and such is shown by the example presented in FIGS. 4 and 5.

Figure 6:
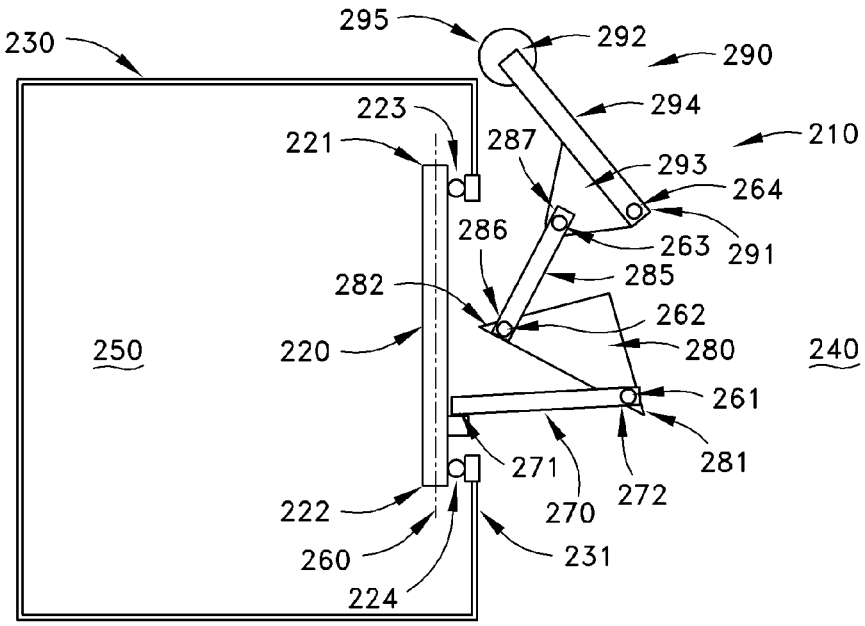
FIG. 6 is a schematic illustration of a third counterweight mechanism for a pressure relief door of a filterhouse in accordance with another aspect of the present invention, with the counterweight mechanism and the door in a first position.
Figure 7:
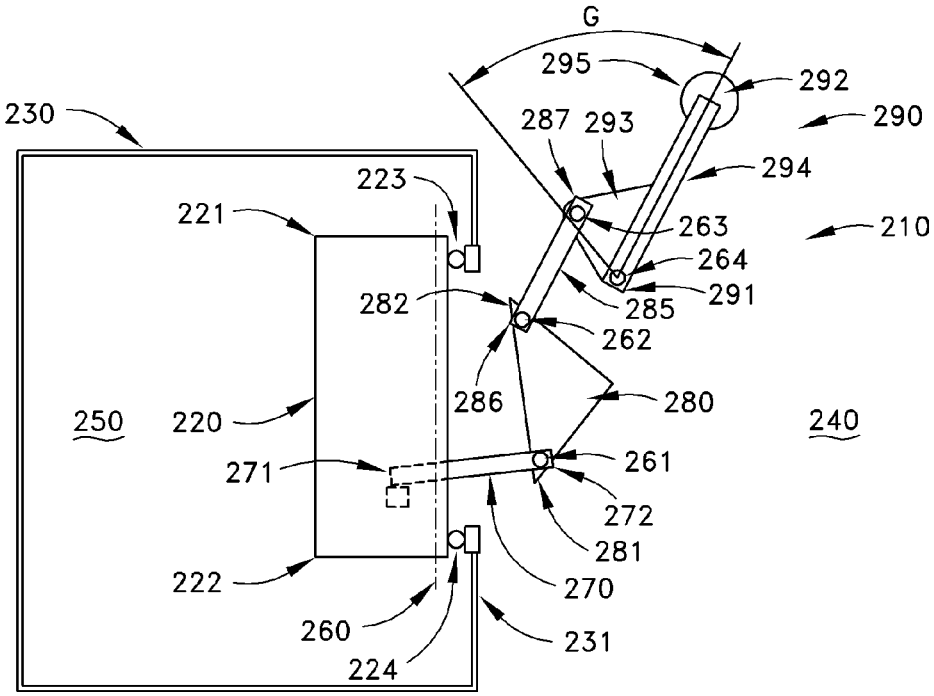
FIG. 7 is a schematic illustration similar to FIG. 6, but with the counterweight mechanism and the door in another position.

FIGS. 6 and 7 schematically illustrate a third embodiment of a counterweight mechanism 210 in a filterhouse 230. The filterhouse 230 associated with third embodiment differs from previously mentioned examples in that a door 220 pivots about a first pivot axis 260 that is a vertical axis (parallel to the plane of the drawing). A door with a vertical pivot axis may provide for different/improved airflow into the filterhouse 230. Similar to the previous embodiments, a sealing arrangement may be provided. For example, the door 220 has a first end portion 221 and a second end portion 222 and seal segments 223 and 224 may optionally be provided on a filterhouse wall 231 for engaging the respective end portions.

A counterweight mechanism 210 is connected to the door 220 and is primarily located in the ambient atmosphere 240 outside the filterhouse 230. The present embodiment of the counterweight mechanism 210 includes an extension member 270, a first linkage 280, a second linkage 285, a radial arm 290, and a counterweight 295.

Focusing on the extension member 270, the extension member 270 has a first end portion 271 and a second end portion 272. The first end portion 271 of the extension member 270 is attached to the door 220. The attachment to the door 220 may not be rigidly fixed and may provide for some pivoting/articulation between the door 220 and the extension member 270. However, the attachment between the door 220 and extension member 270 allows for transmission of forces there between. The shown extension member 270 is rectangular-shaped, but other shapes are possible.

Turning to the first linkage 280, the first linkage 280 is shown as a triangular member but other shapes are possible. The first linkage 280 has a first end portion 281 and a second end portion 282. The first end portion 281 of the first linkage 280 is connected to the second end portion 272 of the extension member 270 at a second pivot axis 261 (perpendicular to the plane of the drawing). The second pivot axis 261 location moves (translates closer to the filterhouse 230 during door opening) as the door 220 pivots. Also, a third pivot axis 262 (perpendicular to the plane of the drawing) is located at the second end portion 282 of the first linkage 280. The second pivot axis 261 location moves (translates further from the filterhouse 230 during door opening) as the door 220 pivots. It is contemplated that the first linkage 280 may be optionally constrained to pivot about an axis located adjacent to the apex of the triangular shape in order to ensure such motion.

The second linkage 285 has a first end portion 286 and a second end portion 287. The first end portion 286 of the second linkage 285 is connected to the second end portion 282 of the first linkage 280 at the third pivot axis 262. The third pivot axis 262 moves (translates further from the filterhouse 230 during door opening and also upward) as the door 220 pivots. The second linkage 285 is shown as a rectangular member, but other shapes are possible.

It is to be appreciated that the extension member 270, the first linkage 280 and the second linkage 285 provide an example of a series of elements that is operatively connected in sequence and that extends from the door 220. As will be appreciated the series of elements move during movement of the door. Also, it is to be appreciated that the series of elements can be varied/modified. Such variation/modification may include a different number of elements.

The radial arm 290 has a first end portion 291 and a second end portion 292. The radial arm 290 includes a triangular connecting member 293 adjacent to the first end portion 291 and a rectangular member 294 extending from the first end portion 291 to the second end portion 292. Similar to the other counterweight mechanism components, the shape of the radial arm 290 can vary. The radial arm 290 is connected, at the triangular connecting member 293, to the second end portion 287 of the second linkage 285 at a fourth pivot axis 263 (perpendicular to the plane of the drawing). The fourth pivot axis 263 moves as the door 220 pivots. The radial arm 290 also has a fifth pivot axis 264. The fifth pivot axis 264 is constrained to prohibit translational movement and thus the radial arm pivots about the fifth pivot axis 264 during operation. Similar to the previous embodiments, a stop may be employed to limit the range of motion of the counterweight mechanism 210 and thus the door 220. Of course, similar to the previous embodiments, the counterweight 295 is fixedly attached to the second end portion 292 of the radial arm 290.

The operation of the door 220 and counterweight mechanism 210 of the third embodiment is similar to the operation of the first and second embodiments because it also has an over-center configuration. FIG. 6 shows the door 220 and counterweight mechanism 210 in a first position. In this position, the door 220 is closed and the radial arm 290 is angled toward the door 220. The counterweight mechanism 210 and door 220 will remain in this position until the pressure differential between the pressure of the ambient atmosphere 240 outside the filterhouse 230 and the pressure of the internal atmosphere 250 inside the filterhouse 230 reaches a predetermined value. In particular, the door 220 will open when the opening urging force from the pressure differential is greater than the closing urging force from the counterweight mechanism 210.

The second linkage 285 is pivotally connected to the first linkage 280 at the third pivot axis 262 and is pivotally connected to the radial arm 290 at the fourth pivot axis 263. The second linkage 285 experiences rotational motion from its pivotal connections, as well as translational motion from its connection to the door 220 via the extension member 270 and the first linkage 280. If the door 220 pivots open, the movement of the first linkage 280 creates a moment of force acting on the second linkage 285 about the third pivot axis 262. This moment will cause the second linkage 285 to move upwards, and the first end portion 286 of the second linkage 285 with rotate with the first linkage 280. At the same time, the weight of the counterweight 295 creates a moment of force that rotates the second end portion 287 of the second linkage 285 away from the door 220.

Similar to the previous embodiments, the radial arm 290 and counterweight 295 may reach a vertical or over-center position, which is intermediate the positions shown in FIGS. 6 and 7. In this over-center position, the counterweight 295 provides neither an opening force nor a closing force. As such, if the counterweight 295 reaches the over-center position and there is still a pressure difference, the door 220 and counterweight mechanism 210 will continue to rotate toward the position shown in FIG. 7. Also similar to the previous embodiments, if the counterweight 295 goes over center, it provides an opening urging force. The counterweight mechanism 210 must be reset in order for the door 220 to close.

The change in position of the door 220 from the position shown in FIG. 6 to the position shown in FIG. 7 defines an angle G, and the simultaneous change in position of the radial arm 290 and counterweight 295 also has an angle (not shown) of the amount of movement. Angle G may be different from (e.g., greater than) the angle of the door movement.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims.

What is claimed:

1. A counterweight mechanism for applying a closing urging force at a first condition to a door and an opening urging force at a second, different condition to the door, the counterweight mechanism including:

a series of movable elements operatively connected in sequence and at least one of the elements extending directly from the door, the series of elements moving during movement of the door; and a radial arm and a weight fixed to the radial arm, the radial arm and weight being pivotally supported and operatively directly connected to another one of the series of elements, with the series of elements interposed between the door and the radial arm and weight, for movement of the radial arm and weight during movement of the door and the series of elements, the weight being responsive to gravity and providing the closing urging force, via force applied by the radial arm to the series of elements in a first direction, that is transmitted through the radial arm and the series of elements to the door when the weight is in a first position, the closing urging force being reduced as the weight moves toward a second position, and the weight being responsive to gravity and providing the opening urging force, via force applied by the radial arm to the series of elements in a second direction that is opposite to the first direction, when the weight is in a third position, the second position of the weight is an over-center position relative to a pivot of the radial arm and weight and in which the weight does not provide the closing urging force or the opening urging force.

2. The counterweight mechanism of claim 1, wherein the series of elements includes an extension member attached to the door.

3. The counterweight mechanism of claim 2, wherein the extension member is fixed relative to the door.

4. The counterweight mechanism of claim 2, wherein the extension member is attached to the door via an articulation.

5. The counterweight mechanism of claim 2, wherein the series of elements includes a linkage, the linkage is operatively connected to the extension member at a pivot axis and operatively connected to the radial arm via another pivot axis, during movement of the door, the linkage moves and transmits motive force between the radial arm and the extension member attached to the door.

6. The counterweight mechanism of claim 5, wherein during opening of the door caused by force urging the door open, the linkage moves generally upwardly and transmits force to the radial arm, and the radial arm and weight pivot in response to the force transmitted from the linkage.

7. The counterweight mechanism of claim 6, wherein when the weight is in the first position the radial arm transmits a downward force to the linkage which in turn is transmitted toward the door as a closing urging force, and when the weight is in the third position the radial arm transmits an upward force to the linkage which in turn is transmitted toward the door as an opening urging force.

8. The counterweight mechanism of claim 1, wherein the door is a door of a filterhouse and the counterweight mechanism is located inside the filterhouse.

9. The counterweight mechanism of claim 1, wherein the door is a door of a filterhouse and the counterweight mechanism is located outside of the filterhouse.

10. The counterweight mechanism of claim 1, wherein the pivot movement of the radial arm and weight between the first and third positions is through a first angle, the door moves in a pivot movement simultaneous with the pivot movement of the radial arm and weight between the first and third positions, the simultaneous pivot movement of the door is through a second angle, and the second angle is less than the first angle.

11. The counterweight mechanism of claim 1, wherein the counterweight mechanism is configured such that once the radial arm and weight are in the third position the counterweight mechanism cannot independently move the radial arm and weight toward the first and second positions, and a resetting force from a source other than from the counterweight mechanism and the door is required to move the radial arm and weight from the third position toward the first and second positions.

12. A counterweight mechanism for applying a closing urging force at a first condition to a door and an opening urging force at a second, different condition to the door, the door being supported for pivot movement about an axis, the counterweight mechanism including:

a series of movable elements operatively connected in sequence and at least one of the elements extending directly from the door, the series of elements moving during movement of the door; and a radial arm and a weight fixed to the radial arm, the radial arm and weight being pivotally supported for movement about an axis and operatively directly connected to another one of the series of elements, with the series of elements interposed between the door and the radial arm and weight, for pivot movement of the radial arm and weight during simultaneous pivot movement of the door, the radial arm and weight are movable from a first position, in which the weight being responsive to gravity and provides the closing urging force, via force applied by the radial arm to the series of elements in a first direction, through a second position and to a third position, in which the weight being responsive to gravity and provides the opening urging force, via force applied by the radial arm to the series of elements in a second direction that is opposite to the first direction, the pivot movement of the radial arm and weight between the first and third positions is a first angle amount and the simultaneous pivot movement of the door is through a second angle, the second angle is less than the first angle;

wherein the closing urging force is reduced as the weight moves from the first position toward the second position, the second position of the weight is an over-center position relative to a pivot of the radial arm and weight and in which the weight does not provide the closing urging force or the opening urging force.

13. The counterweight mechanism of claim 12, wherein the series of elements includes an extension member attached to the door.

14. The counterweight mechanism of claim 13, wherein the series of elements further includes a linkage, the linkage is operatively connected to the extension member at a pivot axis and operatively connected to the radial arm via another pivot axis, during movement of the door, the linkage moves and transmits motive force between the radial arm and the extension member attached to the door.

15. The counterweight mechanism of claim 14, wherein during opening of the door caused by force urging the door open, the linkage moves generally upwardly and transmits force to the radial arm, and the radial arm and weight pivot in response to the force transmitted from the linkage.

16. The counterweight mechanism of claim 12, wherein the door is a door of a filterhouse and the counterweight mechanism is located outside of the filterhouse.

17. A counterweight mechanism for applying a closing urging force at a first condition to a door and an opening urging force at a second, different condition to the door, the counterweight mechanism including:

a series of movable elements operatively connected in sequence and at least one of the elements extending directly from the door, the series of elements moving during movement of the door; and a radial arm and a weight fixed to the radial arm, the radial arm and weight being pivotally supported for movement about an axis and operatively directly connected to another one of the series of elements, with the series of elements interposed between the door and the radial arm and weight, for pivot movement of the radial arm and weight during simultaneous pivot movement of the door, the radial arm and weight are movable from a first position, in which the weight being responsive to gravity provides the closing urging force, via force applied by the radial arm to the series of elements in a first direction, through a second position and to a third position, in which the weight being responsive to gravity provides the opening urging force, via force applied by the radial arm to the series of elements in a second direction that is opposite to the first direction;

the counterweight mechanism being configured such that the second position of the weight is an over-center position relative to a pivot of the radial arm and weight and in which the weight does not provide the closing urging force or the opening urging force and such that once the radial arm and weight are in the third position the counterweight mechanism cannot independently move the radial arm and weight toward the first and second positions, and a resetting force from a source other than from the counterweight mechanism and the door is required to move the radial arm and weight from the third position toward the first and second positions.

18. The counterweight mechanism of claim 17, wherein the closing urging force provided by the weight is reduced as the weight moves toward a second position, the door being supported for pivot movement about an axis, the pivot movement of the radial arm and weight is simultaneous with pivot movement of the door, the pivot movement of the radial arm and weight between the first and third positions is a first angle amount and the simultaneous pivot movement of the door is through a second angle, the second angle is less than the first angle.

* * * * *